US006973766B2

(12) United States Patent
Klapp et al.

(10) Patent No.: US 6,973,766 B2
(45) Date of Patent: Dec. 13, 2005

(54) DEVICE FOR PACKING FLAT ARTICLES IN TRANSPORT CONTAINERS, PARTICULARLY FOLDED-FLAT FOLDING BOXES IN CASING CARTONS

(75) Inventors: Hartmut Klapp, Kaarst (DE); Wolfgang Diehr, Grevenbroich (DE); Klaus Steves, Willich (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/410,625

(22) Filed: Apr. 9, 2003

(65) Prior Publication Data

US 2003/0233815 A1 Dec. 25, 2003

(30) Foreign Application Priority Data

Apr. 9, 2002 (DE) ..... 102 15 646
Jun. 11, 2002 (DE) ..... 102 25 865

(51) Int. Cl.[7] ..... B65B 35/44
(52) U.S. Cl. ..... 53/542; 53/534; 53/251
(58) Field of Search ..... 53/244, 248, 249, 53/246, 250, 251, 259, 260, 473, 475, 447, 534, 542, 541, 527; 271/182, 186, 197, 198, 184, 256, 200–202, 213, 214, 216; 198/460.3, 689.1

(56) References Cited

U.S. PATENT DOCUMENTS

| | | | | |
|---|---|---|---|---|
| 3,932,982 A | | 1/1976 | Klapp | |
| 4,161,095 A | * | 7/1979 | Buday | 53/527 |
| 4,237,677 A | * | 12/1980 | Klapp | 53/505 |
| 4,240,539 A | | 12/1980 | Klapp | |
| 4,676,050 A | * | 6/1987 | Odenthal | 53/447 |
| 5,588,285 A | | 12/1996 | Odenthal | |
| 6,694,706 B1 | * | 2/2004 | Odenthal et al. | 53/443 |

FOREIGN PATENT DOCUMENTS

| | | |
|---|---|---|
| DE | 214 859 | 10/1907 |
| DE | 1 806 865 | 6/1969 |
| DE | 2 261 416 | 7/1974 |
| DE | 27 08 762 A1 | 9/1977 |
| DE | 28 25 420 A1 | 12/1979 |
| DE | 28 25 647 A1 | 12/1979 |
| DE | 28 25 648 A1 | 12/1979 |
| DE | 37 10 916 A1 | 10/1988 |
| DE | 38 10 132 C1 | 9/1989 |
| DE | 195 20 775 A1 | 12/1996 |
| EP | 0 002 106 A1 | 5/1979 |
| GB | 1 205 621 | 9/1970 |
| GB | 1 527 574 | 10/1978 |
| GB | 2 022 558 A | 12/1979 |
| GB | 2 030 952 A | 4/1980 |
| GB | 2 163 721 A | 3/1986 |
| JP | 04 345 437 | 12/1992 |
| JP | 05 112 305 | 5/1993 |

* cited by examiner

*Primary Examiner*—Rinaldi I. Rada
*Assistant Examiner*—Hemant Desai
(74) *Attorney, Agent, or Firm*—Laurence A. Greenberg; Werner H. Stemer; Gregory L. Mayback

(57) ABSTRACT

A device for packing flat articles in transport containers, particularly folded-flat folding boxes in casing cartons, includes a feeder for feeding the flat articles in imbricated form. A conveyor is disposed downstream of the feeder and has an end for discharging the articles into the transport containers at a filling location. Equipment is provided for further conveying the transport containers at the filling location. A transition is provided between the feeder for the flat articles and the downstream conveyor. The transition is an accumulating and transfer device and has an imbricating roller adjustably secured on the conveyor and a height-adjustable hold-down bar fastened to the conveyor. The hold-down bar and the imbricating roller are adjustable in position for coupling with one another.

4 Claims, 8 Drawing Sheets

DEVICE FOR PACKING FLAT ARTICLES IN TRANSPORT CONTAINERS, PARTICULARLY FOLDED-FLAT FOLDING BOXES IN CASING CARTONS

BACKGROUND OF THE INVENTION

Field of the Invention

The invention relates to a device for packing flat articles in transport containers, particularly folded-flat folding boxes in casing cartons. The device includes a feeder for feeding the flat articles in imbricated form, a conveyor disposed downstream therefrom and having an end for discharging the articles into the transport containers at a filling location, and equipment for further conveying the transport containers at the filling location.

German Published, Non-Prosecuted Patent Application 28 25 647, corresponding to UK Patent Application GB 2 022 558, discloses a device of the general type described in the introduction hereto, namely for packing folded-flat folding boxes in casing cartons. In that device, a conveyor has a lowering rail and a pivoting rail, each with a revolving belt. Between the belts, the folding boxes, which are fed in imbricated form, are conveyed into casing cartons as transporting containers. The lowering rail therein serves as an abutment, which interacts with the pivoting rail at the discharge location in order for the folding boxes to be guided as far as possible into the definitive position thereof in the transport container. In order to allow precise positioning of the lowering and pivoting rails in the transport container, the at least approximately vertically moveable lowering rail has fastened thereon a longitudinally displaceable switching rail, which projects beyond the lowering rail in the downward direction and actuates a switch as soon as it is positioned on the base of the transport container. As a result, the operation of lowering the lowering and pivoting rails by an hydraulic drive is stopped at a defined distance from the base of the transport container. Adjustment of the distance, for example for adaptation to different folding-box formats, is only possible by a mechanical intervention in the construction of the conveyor.

German Published, Non-Prosecuted Patent Application 28 25 648, corresponding to UK Patent Application GB 2 030 952, likewise describes a device for introducing folding-box blanks into transport containers, wherein the blanks are guided between a top belt and a bottom belt of the conveyor. The bottom and the top belts of the conveyor therein are driven by independent drives which are not specifically described. A further packing device of that type is described in German Published, Non-Prosecuted Patent Application 2 261 416. The bottom belt of the conveying configuration wraps around a drive roller and deflecting rollers, which define a curved conveying path. Specific details regarding the construction of the drives are also not disclosed therein.

SUMMARY OF THE INVENTION

It is accordingly an object of the invention to provide a device for packing flat articles in transport containers, particularly folded-flat folding boxes in casing cartons, which overcomes the hereinafore-mentioned disadvantages of the heretofore-known devices of this general type, which reliably conveys and discharges flat articles at high speeds, for quick adjustment to different formats of the articles and/or transport containers and for allowing for wide-ranging automation and space-saving construction.

With the foregoing and other objects in view, there is provided, in accordance with the invention, a device for packing flat articles in transport containers, comprising a feeder for feeding the flat articles in imbricated form. A conveyor is disposed downstream of the feeder and has an end for discharging the articles into the transport containers at a filling location. A transition between the feeder for the flat articles and the downstream conveyor is an accumulating and transfer device having an imbricating roller adjustably secured on the conveyor and a height-adjustable hold-down bar fastened to the conveyor. The hold-down bar and the imbricating roller are adjustable in position to be coupled with one another. Equipment is provided for further conveying the transport containers at the filling location.

In accordance with another feature of the invention, the packing device further includes a drive for performing the coupled adjustment of the hold-down bar and of the imbricating roller. The drive is an electrically controllable servomotor.

In accordance with a further feature of the invention, the conveyor has an at least approximately vertically extending end at the filling location.

In accordance with a concomitant feature of the invention, the flat articles are folded-flat folding boxes, and the transport containers are casing cartons.

The object of the invention is thus achieved, in that the transition between the feeder for the articles, and the downstream conveyor is configured as an accumulating and transfer device having an imbricating roller, which is fastened in an adjustable manner on the conveyor, and a height-adjustable hold-down bar fastened on the conveyor. It is possible for the positions of the hold-down bar and of the imbricating roller to be adjusted in a coupled manner with one another. This provides the advantage that the operation of adjusting the feeder to different articles is simplified to a considerable extent, and that setting errors are avoided.

It is preferably possible for a drive serving for the coupled adjustment of the hold-down bar and of the imbricating roller to be an electrically controllable servomotor. That, in turn, constitutes an advantage with respect to the automation capability of the feeder.

Other features which are considered as characteristic for the invention are set forth in the appended claims.

Although the invention is illustrated and described herein as embodied in a device for packing flat articles in transporting containers, in particular folded-flat folding boxes in casing cartons, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
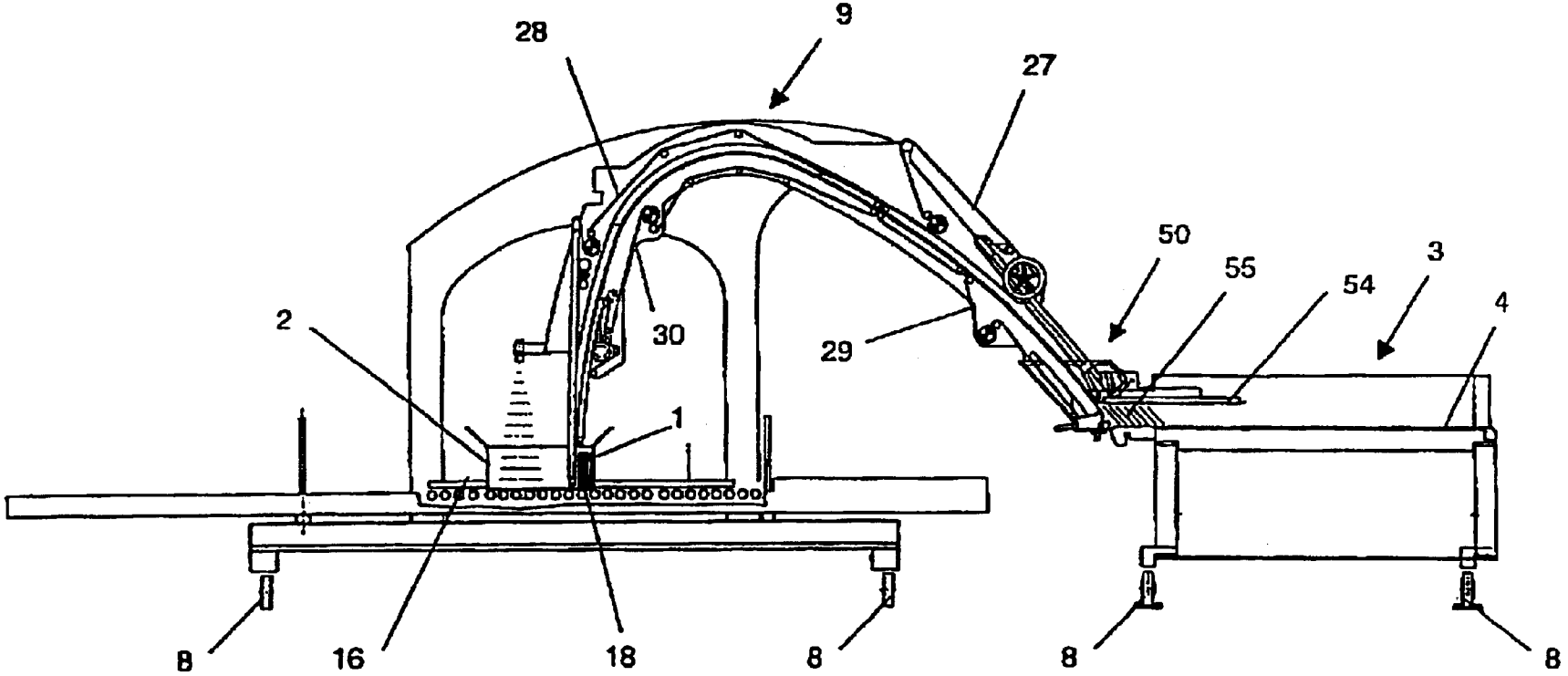
FIG. 1 is a diagrammatic, side-elevational view of a packing device according to the invention.

Referring now to the figures of the drawings in detail and first, particularly, to FIG. 1 thereof, there is seen an exemplary embodiment of a packing device serving for packing folded-flat folding boxes 1 in casing cartons 2. The packing device is disposed downstream from a folding-box adhesive-bonding machine, wherein folding boxes are produced from blanks.

Figure 2:
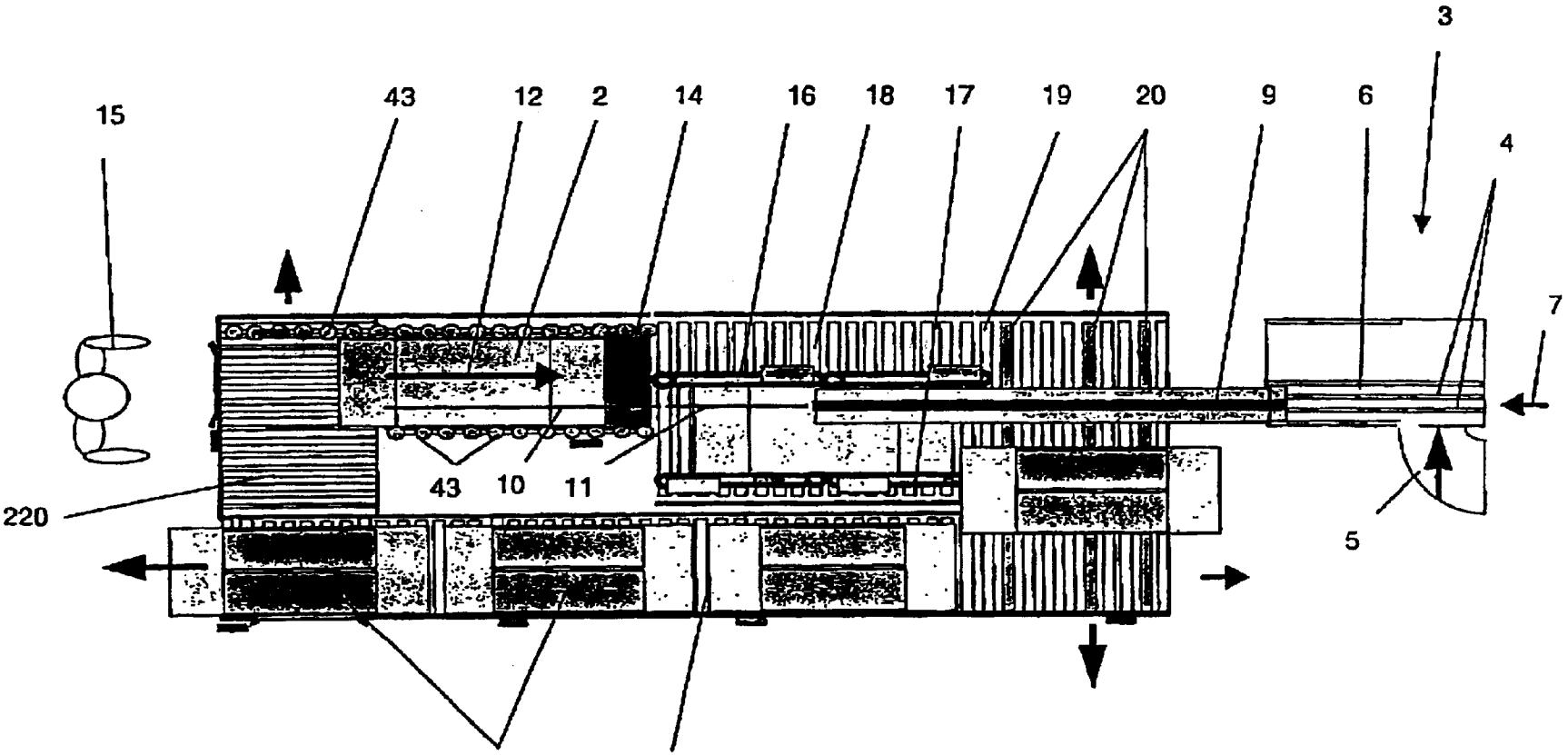
FIG. 2 is a plan view of the packing device wherein individual constituent parts are illustrated diagrammatically.
Figure 9:
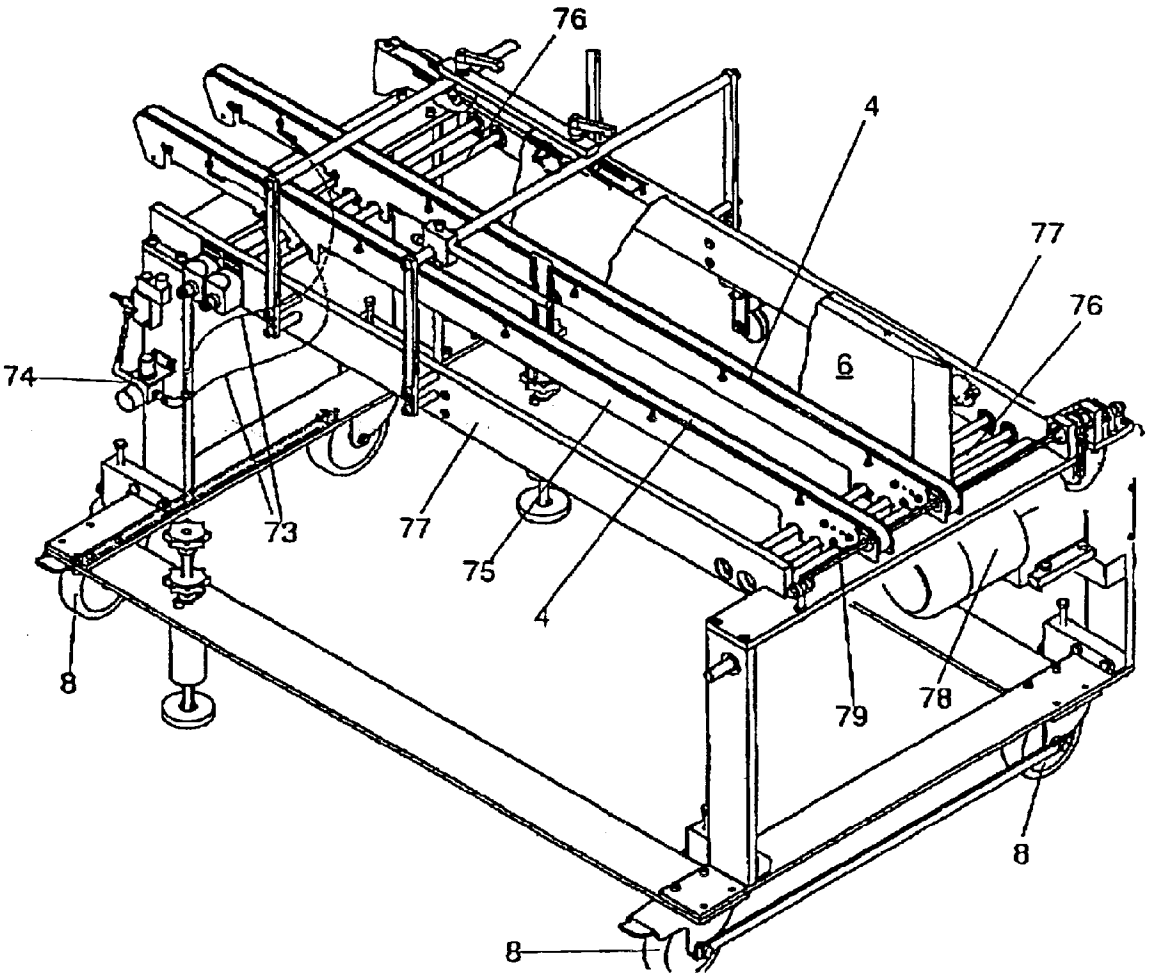
FIG. 9 is a front, side and top perspective view of the folding-box feeder disposed upstream of the conveyor and showing the detailed construction thereof.

The packing device starts with a folding-box feeder 3, to which the folded-flat folding boxes 1 are fed in imbricated form from the folding-box adhesive-bonding machine. The feeder 3 has, as conveyors, two belts 4, whereon the folding boxes 1 are conveyed in a horizontally disposed condition. The feeder 3 illustrated in FIGS. 1, 2 and 9 is preferably constructed in such a way that the folding boxes 1 are conveyed further either in a rectilinear condition, without being rotated, or in a condition wherein they have been rotated through 90° to the lefthand or righthand sides of the respective figures. This makes it possible for the folding boxes 1 to be packed in the casing cartons 2 in an upright condition either with the leading edge or one of the side edges thereof at the bottom of the respective figure. If the blanks 1 are to be rotated through 90°, they are supplied to the belts 4 via a lateral roller conveyor 5 with a conveying section curved through 90° and, during transfer, they are aligned on a stop 6 which is parallel to the belts 4 and can be adjusted transversely to different box formats. If the folding boxes 1 are to be conveyed further by the folding-box adhesive-bonding machine in a rectilinear state, without being rotated, they are fed centrally in the direction of an arrow 7. In order for the respectively desired supply inlet 5 or 7 to be adjustable or settable, the feeder 3 and the rest of the packing device are mounted in such a way that they can be adjusted transversely on rollers 8, as illustrated in FIG. 1.

The feeder 3 illustrated in FIG. 2 allows folding boxes 1 to be conveyed further only in a rectilinear condition or in a condition wherein they have been rotated through 90° to the righthand side of FIG. 2. If rotation through 90° to the lefthand side is also to be permitted, the feeder 3 has, on the second longitudinal side, i.e., at the top in FIG. 2, a further roller conveyor, of which the conveying section runs rotatively through 90° to the lefthand side of the figure.

The folding boxes are transferred from the feeder to a conveyor 9 which includes, as conveying elements, at least one pair of belts with a top belt 27, 28 and a bottom belt 29, 30, between which the folding boxes 1 are retained and conveyed. The conveying section of the conveyor 9 initially curves upwardly and then downwardly, and terminates with an approximately vertical profile at the filling location, at which the folding boxes 1 are packed in an upright condition in the casing cartons 2.

FIG. 2 is a plan view of the configuration of the various conveyors by which empty casing cartons 2 are fed to the filling location at the end of the conveyor 9, and cartons 2 filled with folding boxes are transported away.

It is an important feature for the invention that the empty casing cartons 2, which are to be filled, be fed to the filling location in a rectilinear condition counter to the transporting direction of the folding boxes 1. The feeding direction is represented by the arrow 12 in FIG. 2. For this purpose, the packing device has, downstream from the filling location, as viewed in the conveying direction of the boxes 1, a belt conveyor 14 which conveys in the direction of the arrow 12, and whereon the empty casing cartons 2 are positioned from behind by an operator represented at 15. The belt conveyor 14, which is provided with a belt drive, transfers the empty casing cartons 2 to two lateral belt conveyors 16 and 17, which extend through the filling region by way of vertically running belts. The two belt conveyors 16 and 17, which are movable transversely, respectively, by a drive, act upon the sides of the casing carton 2 at the bottom, respectively, and firmly clamp the carton therebetween. For filling purposes, the end of the conveyor 9 is moved into the casing carton 2; during the filling operation, the two belt conveyors 16 and 17 move the casing carton 2 farther at the required speed, in order for the boxes to be disposed in the casing carton 2 in a condition wherein they stand in a row directly adjacent to one another. In order for the casing carton 2 to be moved forward exclusively via the belt conveyors 16 and 17 during the filling operation, freely rotatable rollers 18 are disposed as a supporting surface in the filling region, so that the casing cartons 2 stand on the rollers 18. The belt conveyors 16 and 17 are followed, as viewed in the transporting direction of the casing carton 2, by a roller conveyor 19 which has driven rollers, and further transports the filled cartons 2. Hold-down bars 10 and 11 are preferably disposed along the conveying path of the casing cartons 2 to as far as the filling location, the hold-down bars forcing the cover flaps of the casing cartons 2 outwardly and thus keeping the cartons 2 in the open position.

Figure 11:
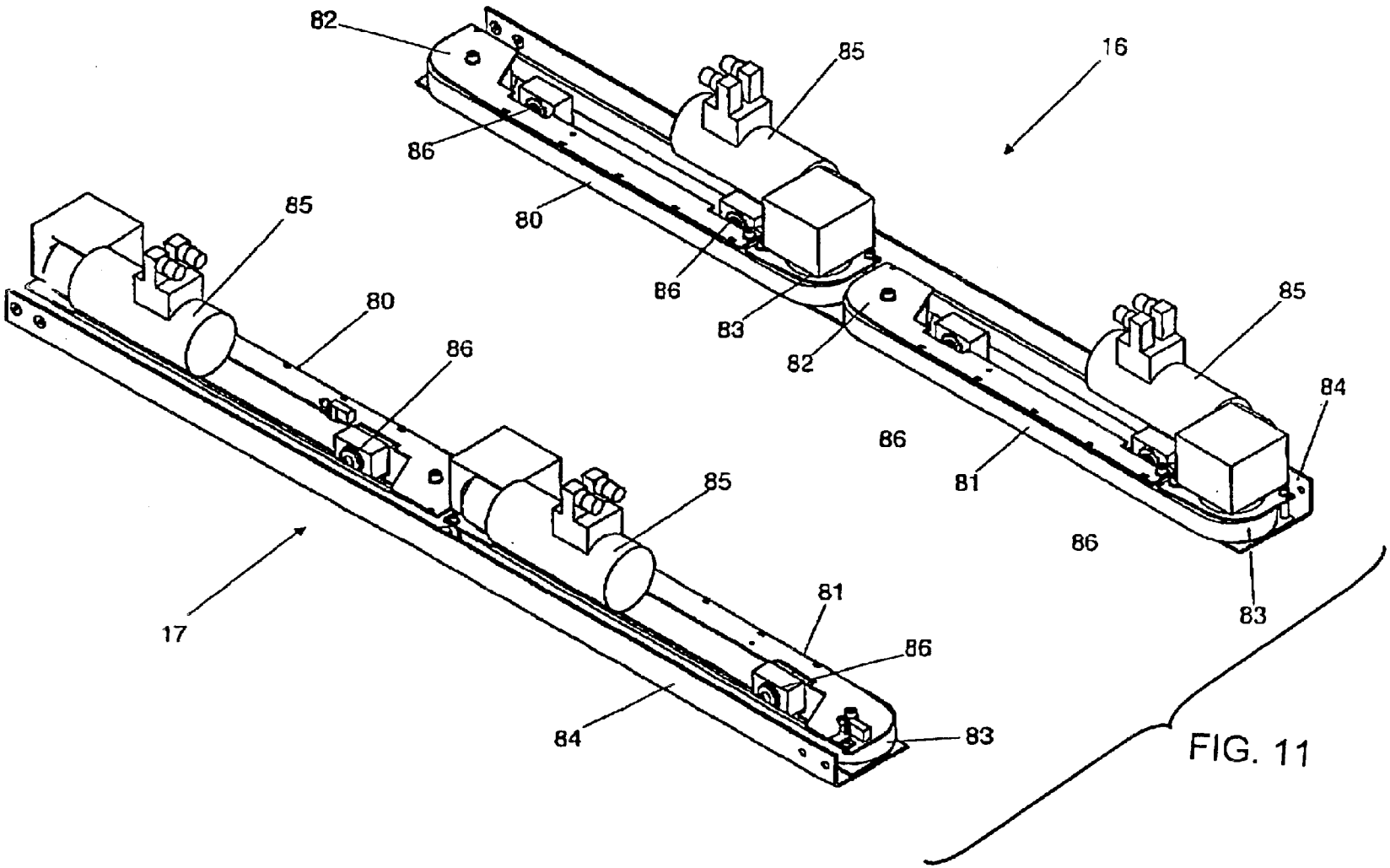
FIG. 11 is a top, side and front perspective view of the belt conveyors at the filling location.

The two lateral belt conveyors 16 and 17 are illustrated in greater detail in FIG. 11, and move the casing cartons 2 forward during the filling operation. The two belt conveyors 16 and 17 are preferably constructed in a mirror-inverted manner relative to one another and are, respectively, individually mounted so as to be adjustable transversely to the transporting direction thereof, by a non-illustrated linear drive. Each belt conveyor 16, 17 preferably has two conveying belts 80 and 81, which are driven independently of one another and of which the conveying strands run vertically, respectively, and are disposed in alignment behind one another. Each of the revolving conveying belts 80, 81 is deflected by deflecting rollers 82, 83 which are fastened, by way of vertical spindles, on a common longitudinal carrier 84 so that the conveying strand, respectively, on the inside, runs outside the region of the longitudinal carrier 84. Each conveying strand is supported on the rear side thereof by resilient elements 86. Each longitudinal carrier 84 is adjustable transversely by a linear drive, with the result that the two belt conveyors 16, 17 can be moved towards one another and away from one another in order to retain a casing carton 2 in a clamped condition. Each conveying belt 80, 81 of a belt conveyor 16, 17 is connected to a rotary drive 85, which drives one of the deflecting rollers 83 via a mitre gear. The two-part form of each belt conveyor 16, 17 offers the advantage that two independent conveyors are provided behind one another. This makes it possible for empty casing cartons to be fed by the two first conveying belts 80, while filled casing cartons 2 are transported away by the second conveying belts 81. The drives 85 used for the conveying belts 80, 81 are preferably electric servomotors which allow precise control of the advancement of a casing carton 2 during the filling operation.

Figure 6:
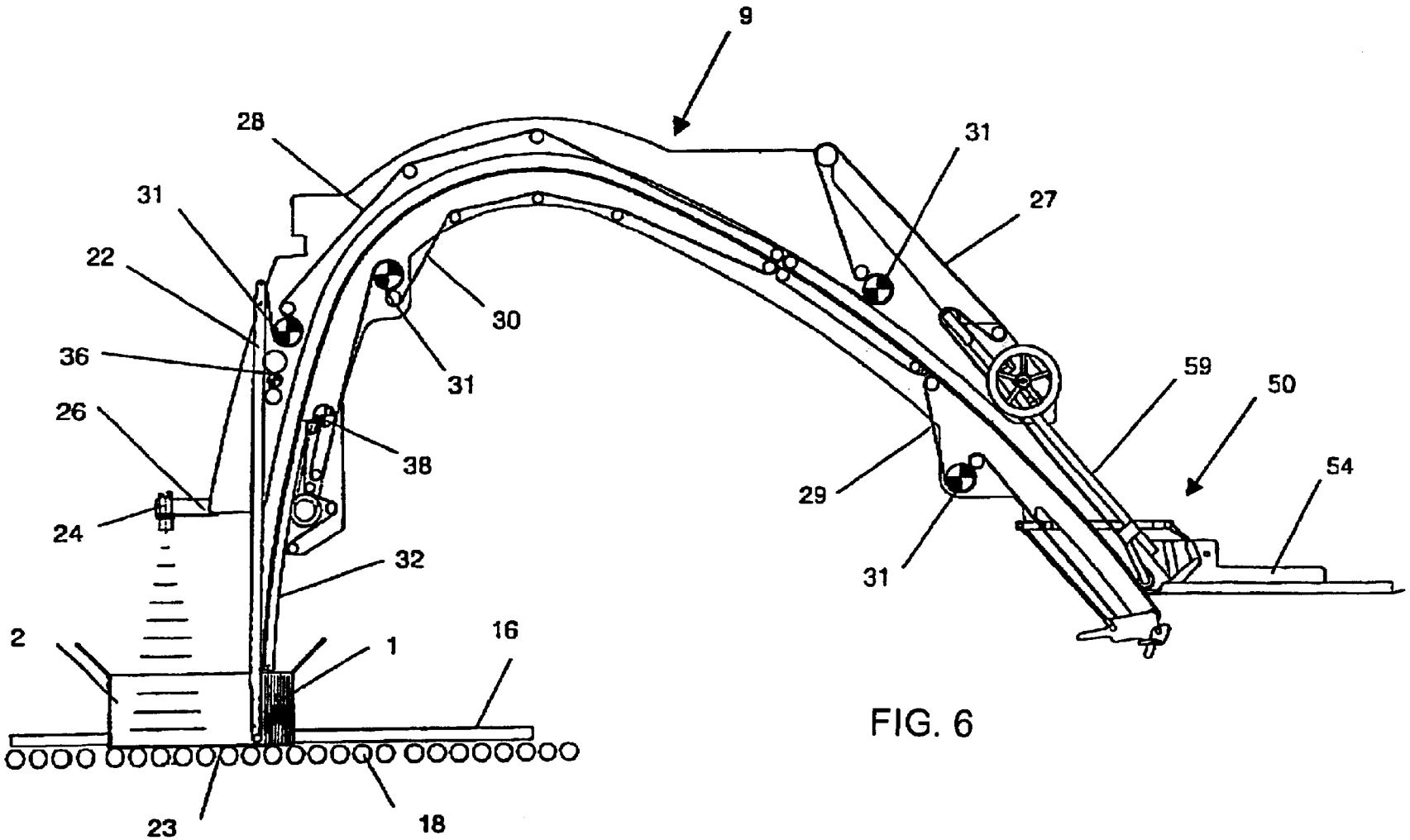
FIG. 6 is an enlarged, fragmentary view of FIG. 1, showing the conveyor thereof.

The construction of the conveyor 9 is illustrated in greater detail in FIG. 6. It has, at the end thereof, a lowerable pivoting rail 32 and a lowerable rail 22 that is lowerable in an at least approximately vertical movement to as far as the base 23 of a casing carton 2. FIG. 6 illustrates the phase position wherein the rail has been moved into the carton 2. Fastened to the stationary mounting of the vertically lowerable rail 22 is a sensor 24 which, in a contactless manner, determines the distance between the vertically bottom end of the vertically lowerable rail 22 and the base 23 of the casing carton 2. The sensor 24 that is preferably used is an ultrasonic sensor which is fastened to the load-bearing structure of the conveyor 9 via an angle plate 26. The sensor 24 permits the distance between the end of the vertically lowerable rail 22 and the base 23 of the casing carton 2, or a layer of boxes 1 which is already located in the casing carton, to be adjusted automatically.

The conveyor 9 has at least one driven pair of belts including a top belt 27, 28 and a bottom belt 29, 30. The boxes 1 are conveyed in a condition wherein they lie horizontally between the respective belts 27, 29 and 28, 30 and are retained thereby. It is preferable for two driven pairs of belts to be disposed behind one another along the conveying section, it being possible for the top belts 27, 28 and the bottom belts 29, 30, respectively, thereof to be driven independently of one another. In the preferred embodiment illustrated in the figures, the conveyor 9 has two conveying sections with, respectively, two separate belts 27, 29 and 28, 30, each belt 27, 28, 29, 30 having a dedicated independent drive 31. The drives 31 which are used are electrically operated, controllable servomotors which allow precise control of the respective belt speed. The top belt 28 of the second conveying section is mounted on the vertically lowerable rail 22, and the associated bottom belt 30 is mounted on the pivoting rail 32.

Dividing the conveying section of the conveyor 9 into two sub-sections offers the advantage that, respectively, the predetermined number of boxes 1 of one layer can be deposited in casing cartons 2 by the second pair of conveying belts 28, 30, while the boxes 1 for the next layer are accumulated and held back in the first pair of conveying belts 27, 29. The supplying of the boxes 1 into the casing cartons 2 can be interrupted in order to move the vertically lowerable and pivotable rails 22 and 32, respectively, into the position which is necessary for depositing the next layer or in order to convey up a new empty casing carton.

Figure 7:
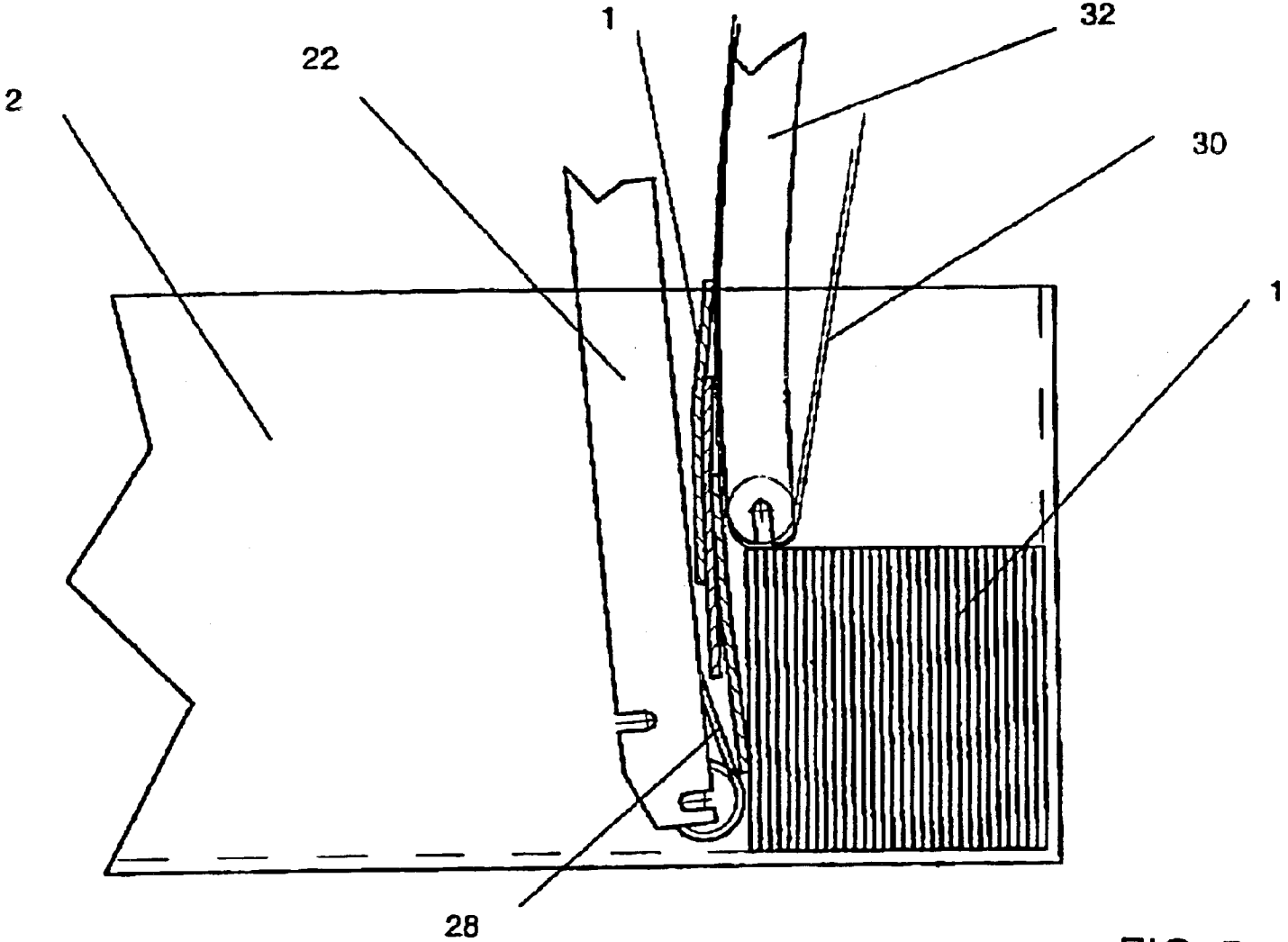
FIG. 7 is an enlarged, fragmentary view of FIG. 6, for clarifying the filling operation.

In order that the vertically lowerable rail 22 and the pivotable rail 32 may be lowered into a casing carton 2, they are each provided with a separate lifting drive 36, 38. It is also preferable for the drives 36, 38 to be electrically operated, controllable servomotors which allow precise control of the lowering movement. FIG. 7 illustrates the vertically lowerable rail 22 and the pivotable rail 32 in the operating position thereof.

Figure 4:
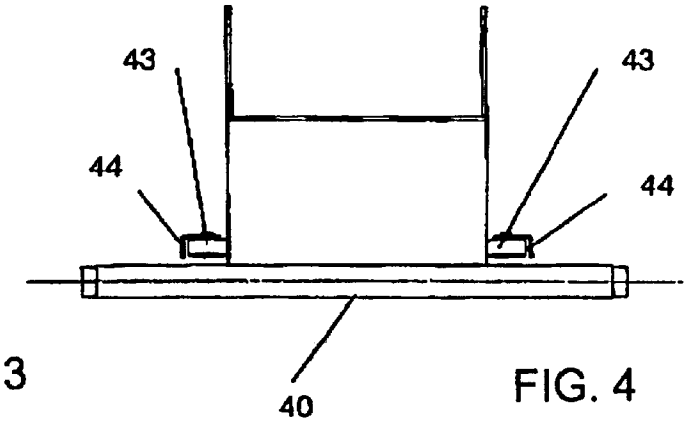
FIG. 4 is a front-elevational view of FIG. 3.
Figure 3:
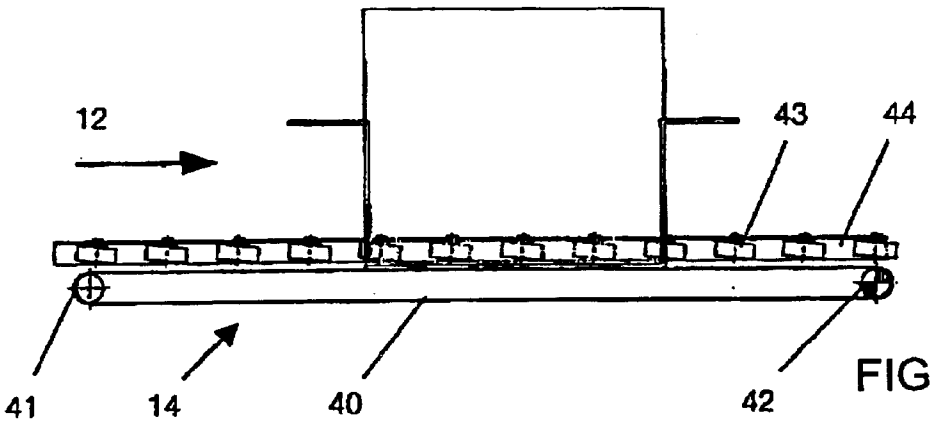
FIG. 3 is a side-elevational view of a feeder for feeding casing cartons to a filling device.
Figure 5:
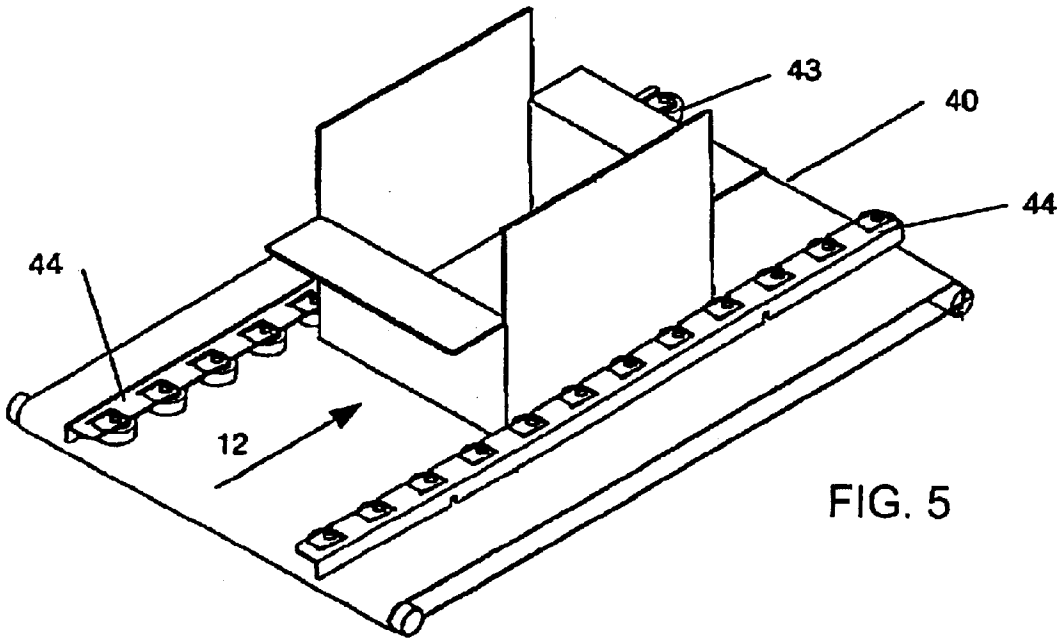
FIG. 5 is a front, side and top perspective view of FIG. 3.

The region of the belt conveyor 14 which conveys the casing cartons 2 to the filling location is illustrated in greater detail in FIGS. 3 to 5. The belt conveyor 14 has a conveying belt 40 which corresponds, in terms of width, at least to the width of a casing carton 2. The belt drive that is used is a servomotor, which drives the outlet-side deflecting roller 42 of the belt 40. On the inlet side, the conveying section is bounded by the deflecting roller 41 of the belt 40.

Disposed at a slight distance above the conveying plane of the belt 40 are two longitudinal carriers or support beams 44 whereon, respectively, a row of guide rollers 43 are mounted so as to be freely rotatable at a distance apart from one another. The spindle of each roller 43 is inclined in the conveying direction at an acute angle to the vertical. The longitudinal carriers 44 with the rollers 43 fastened thereon are adjustable transversely so that the rollers, respectively, guide a casing carton 2 in the bottom region of the side walls. The inclination of the rollers 43 causes the casing carton 2, which is conveyed by the belt 40, to be forced onto the belt 40. The increased contact pressure improves the conveying and, at the same time, prevents the base flaps of the casing carton 2 from opening and forcing the latter upwardly. Because the base flaps of the casing carton 2 are pressed flatly onto the belt 40, the planar base of the casing carton 2 is made available to the distance or spacing sensor 24 as a defined reference surface for distance-determining purposes.

At least one of the longitudinal carriers or support beams 44 is mounted so as to be adjustable transversely, with the result that the distance between the two longitudinal carriers or support beams 44 can be set to different casing-carton widths.

In the simplest form, the packing device includes only the aforedescribed parts with the conveying sections 14, 18 and 19. If the cartons 2 are to be filled with a number of layers of boxes 1 above one another and/or with several rows of boxes beside one another, an operator removes the not yet completely filled casing cartons from the roller conveyor 19, carries them back to the belt conveyor 14 and repositions them there for the next filling operation. Completely filled casing cartons are transported away. This straightforward embodiment offers the advantage that the packing device is no wider than the upstream folding-box adhesive-bonding machine. It can thus also be used for very constricted space conditions. If there is sufficient space in the widthwise direction, use can be made thereof for transporting the casing cartons back automatically, as is illustrated with regard to the embodiment according to FIG. 2.

In the embodiment of FIG. 2, transversely running transporting belts 20 are disposed between the rollers of the roller conveyor 19, it being possible for the transporting belts to be rendered inactive by being lowered beneath the conveying plane of the roller conveyor 19, and to be activated by being raised above this conveying plane. The rollers of the roller conveyor 19 extend transversely beyond the filling region to such an extent that, on the ends thereof, casing cartons 2 can be transported back, past the filling location, in the direction counter to the filling direction. Following the roller conveyor 19, alongside the filling location, is a further roller conveyor 21, of which the conveying section extends, parallel and in the opposite direction to the conveying sections of the conveyors 14, 16, 17, into the region of the start of the belt conveyor 14, and thus forms the end of the packing device on this side. At this end, the conveying section of the roller conveyor 21 is connected to the start of the belt conveyor 14 via a further, transversely conveying roller conveyor 220. This makes it possible, for an automated multilayered filling operation, for cartons to be conveyed, revolving or circulating through the filling location a number of times. In this advantageous embodiment, all that is required is for the operator 15 to position empty cartons on the belt conveyor 14 and to remove filled cartons from the roller conveyor 21. It is also possible for these two manual operations to be automated by the attachment of corresponding conveyors. It is also advantageously possible to place further additional subassemblies along the conveying sections of the conveyors 21 and 22, for example units by which the casing cartons are set in an upright position and opened, or units for closing the filled cartons.

Figure 8:
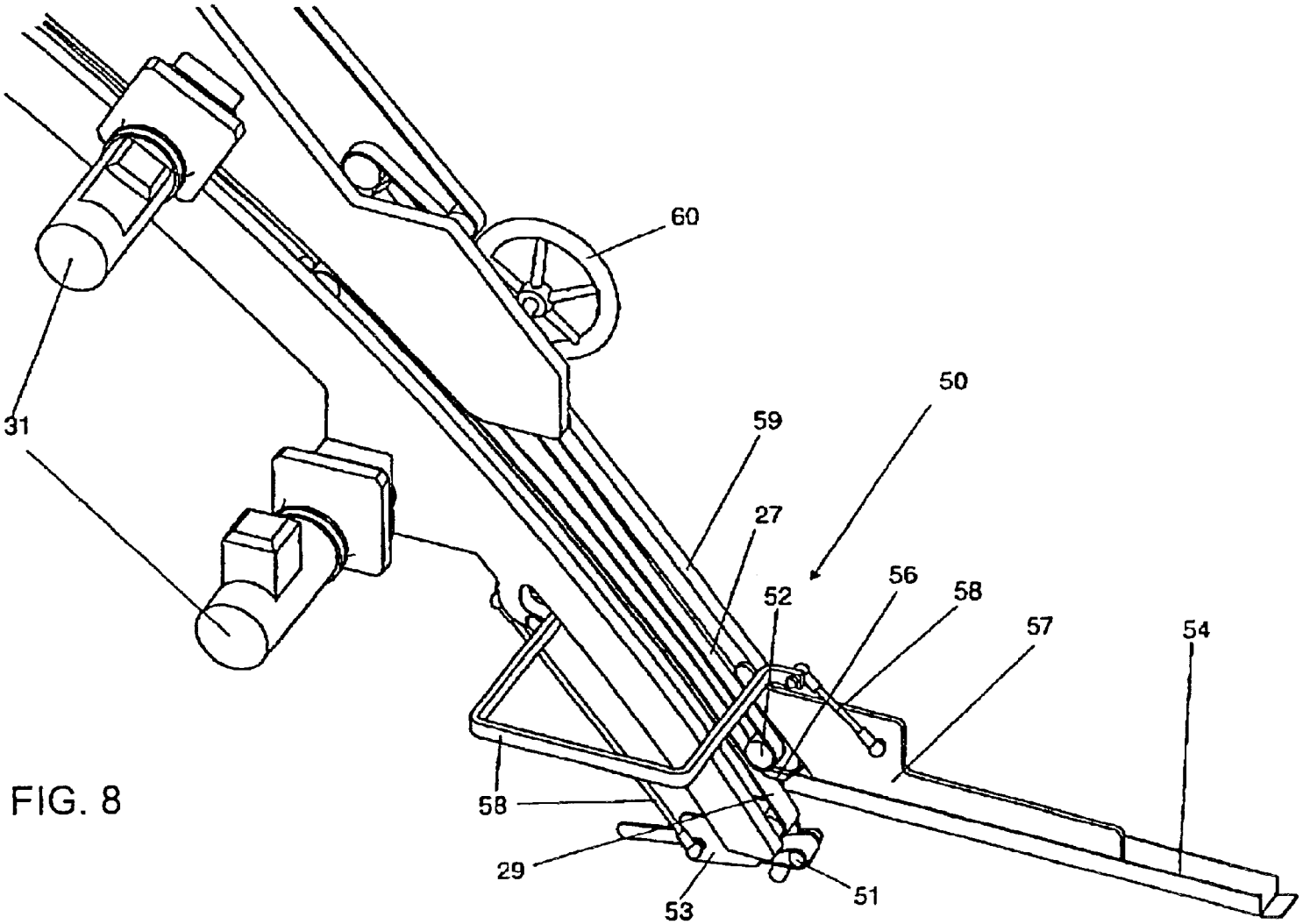
FIG. 8 is a front, side and top perspective view of the beginning of the conveyor.

The transition between the folding-box feeder 3, which is illustrated in FIG. 9, and the conveyor 9 is configured as an accumulating and transfer device 50, of which the parts fastened on the conveyor 9 are illustrated on an enlarged scale in FIG. 8. The accumulating and transfer device 50 has the task of collecting a given number of boxes 1 and transferring them in imbricated form, with a pre-set degree of overlapping, to the belts 27, 29 of the conveyor 9. For this purpose, the boxes 1 are conveyed continuously towards the start of the conveyor 9 by the belts 4 of the feeder 3.

The accumulating and transfer configuration 50 includes an imbricating roller 51 which is disposed at the bottom at the start of the conveyor 9 and, at the same time, forms the inlet-side deflecting roller of the bottom conveying belt 29. The imbricating roller 51 has the task of conveying between the conveying belts 27, 29, respectively, the first box of an assembled stack or pile accumulated in front thereof. The conveying belt 29 which runs around it is guided in a loop to the following deflecting roller 52, which bounds the conveying section of the conveyor 9, with the result that the conveying section is interrupted slightly at the bottom. The position of the imbricating roller 51 relative to the deflecting roller 52 determines the degree of overlapping by which the boxes 1 are drawn off from the feeder 3. The imbricating roller 51 is thus mounted in a pivotable bearing part 53 in order that the degree of imbrication can be adjusted to the desired or nominal value via the position of the imbricating roller 51.

A hold-down bar 54, which extends counter to the conveying direction of the boxes 1, is fastened above the imbricating roller 51, on the conveyor 9. The hold-down bar 54 has the task of holding the boxes 1, which are accumulated upright on edge or edgewise, at the top edge thereof. The distance thereof from the belts 4 of the feeder 3 is adjusted to the box width. Together with the ends of the belts 4, the hold-down bar 54 forms an accumulating section 55, as can be seen from FIG. 1. Because the boxes 1 accumulating in the accumulating section 55 are positioned increasingly vertically as they increase in number, the minimum distance between the top edges of the boxes 1 and the hold-down bar 54 forms a measure of the number of accumulating boxes 1. In order to measure the length of the accumulating stack of boxes and to control the draw-off speed of the conveying belts 27, 29 in dependence thereon, an electromechanical sensor is integrated in the hold-down bar 54 for determining the height of the stack of boxes between the belts 4 and the hold-down bar 54, and thus the number of accumulating boxes 1.

Fastened at the end of the hold-down bar 54 is an elastic imbricating finger 56 which extends towards the bottom transporting belt 29. The distance between the imbricating finger 56 and the bottom transporting belt 29 is adjusted to the thickness of the imbricated line of blanks. As the first box 1 of the accumulating stack of boxes is conveyed away, the next-following box 1 is held back by the imbricating finger 56 in order not to be drawn along by the first box 1. The hold-down bar 54 with the imbricating finger 56 fastened thereon is mounted in a height-adjustable manner, in order that the position thereof may be adapted to different box widths.

The positions of the hold-down bar 54, with the imbricating finger 56, and of the imbricating roller 51 can preferably be adjusted in a coupled manner with one another, as is illustrated in FIGS. 6 and 8. This offers the advantage that a changeover of the accumulating and transfer configuration 50 to a different box format can be carried out very quickly and without involving any great expense outlay. For this purpose, the bearing part 57, whereon the hold-down bar 54 with the imbricating finger 56 is fastened, and the bearing part 53 of the imbricating roller 51 are connected to one another via levers 58, which are adjusted jointly by a handwheel 60 via an adjusting rod 59. The lever mechanism formed by the bearing parts 53, 57 and the levers 58 is configured so that the movements of the hold-down bar 54, with the imbricating finger 56, and of the imbricating roller 51 are coupled to the necessary extent, with the result that, in the case of a format adjustment, each part assumes the new position thereof. In order for the position of the imbricating roller 51 to be additionally adjustable in relative terms, this roller 51 is fastened so that it is additionally adjustable on the bearing part 53 thereof. The jointly coupled adjustment of the elements makes it possible to automate the adjustment. Instead of the handwheel 60, use is then made of an adjusting drive, which moves the adjusting rod 59.

Figure 10:
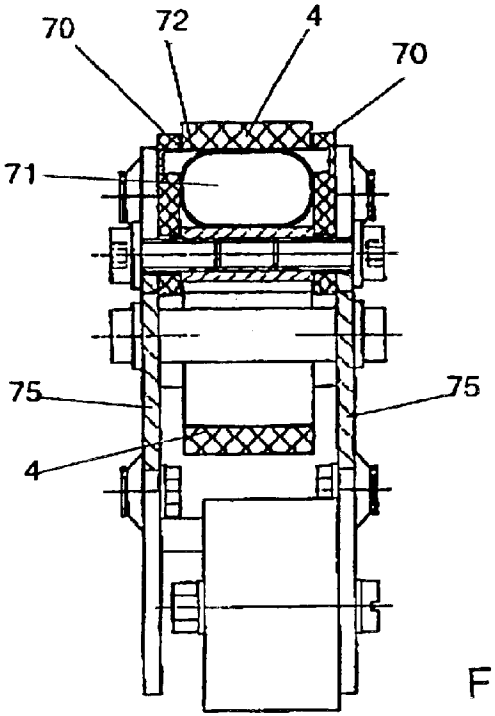
FIG. 10 is an enlarged, fragmentary, cross-sectional view of the conveyor of the folding-box feeder.

The feeder or supply device 3, which is illustrated in greater detail in FIG. 9, includes belts 4 as conveying elements, which extend into the accumulating section 55, and thus also convey in the direction counter to the accumulating boxes 1. They are advantageously configured so that the conveying action of the conveying belts 4 is dependent upon the bearing pressure of the boxes 1, and this dependency can be adjusted in addition. For this purpose, each conveying belt 4, as is illustrated in the sectional view of FIG. 10, is guided between two top guide bars 70, and rests on a flexible pressure tube 71 which can be subjected to the action of compressed air. Disposed between the flexible pressure tube 71 and the conveying belt 4 is a thin, deformable plate 72 via which the conveying belt 4 can slide with low friction. The conveying belt 4 is guided between the guide rails 70, in a manner supported by the flexible pressure tube 71, so that, without being forced downwardly by the weight of the boxes 1 resting thereon, it projects beyond the top surfaces of the guide bars 70. The belt 4 thus acts upon the undersides of the boxes 1 and conveys the latter further. If the weight of the boxes 1 increases, the conveying belt 4 is then forced downwardly counter to the force of the flexible pressure tube 71. In this regard, it moves downwardly relative to the top surfaces of the guide rails 70 until the latter are located in a single plane with the top surface of the belt 4. In this position, the boxes rest on the top surfaces of the rails 70 and are no longer conveyed further by the belt 4. Depending upon the weight of the boxes 1 resting thereon, it is thus possible for a different conveying force to be established over the conveying length of the belts 4. The conveying force is very low in the region of the accumulating section 55, while it is high at the start of the feeder 3 because, thereat, the boxes 1 rest on the belts 4 in a condition wherein they are imbricated at a relatively great distance apart from one another. The change in the conveying action of the belts 4 in dependence upon the weight of the boxes 1 resting thereon can be adjusted via the pressure in the flexible pressure tube 71. For this purpose, each flexible pressure tube 71 is connected to a compressed-air source 70 via lines 73 and a control valve 74.

The two guide rails 70 and the flexible pressure tube 71 with the conveying belt 4 resting thereon, respectively, extend over the entire conveying section of the feeder 3. For this purpose, they are disposed between two plate-like side parts 75, which are screwed to one another and are mounted so that they are adjustable transversely on spindles 76. The spindles 76 extend transversely to the conveying direction and are mounted, by the ends thereof, in side parts 77 of the framework of the feeder 3. Two conveying belts 4 are preferably mounted in the aforedescribed manner, at a distance from one another, respectively, and so that they are adjustable transversely, individually, on spindles 76, and are driven jointly via a tilting shaft 79 connected to a rotary drive 78. The stop 6, which is likewise mounted in a transversely adjustable manner, is illustrated partly in section in FIG. 9. The boxes 1 are aligned on the stop 6 if they are supplied to the conveying belts 4 at an angle of 90° thereto.

We claim:

1. A device for packing flat articles in transport containers, comprising:

a feeder for feeding the flat articles in imbricated form;

a conveyor disposed downstream of said feeder and having an end for discharging the flat articles into the transport containers at a filling location;

a transition between said feeder for the flat articles and said downstream conveyor, said transition being an accumulating and transfer device having an imbricating roller adjustably secured on said conveyor, a height-adjustable hold-down bar including a downstream end, said hold-down bar fastened to said conveyor, and an elastic imbricating finger fastened at said downstream end of said hold-down bar, said hold-down bar with said imbricating finger and said imbricating roller being adjustable in position in a coupled manner with one another; and

2. The packing device according to claim 1, further comprising a drive for performing the coupled adjustment of said hold-down bar with said imbricating finger and of said imbricating roller, said drive being an electrically controllable servomotor.

3. The packing device according to claim 1, wherein said conveyor has an at least approximately vertically extending end at said filling location.

4. The packing device according to claim 1, wherein the flat articles are folded-flat folding boxes, and the transport containers are casing cartons.

* * * * *

UNITED STATES PATENT AND TRADEMARK OFFICE

CERTIFICATE OF CORRECTION

PATENT NO. : 6,973,766 B2
DATED : December 13, 2005
INVENTOR(S) : Hartmut Klapp et al.

It is certified that error appears in the above-identified patent and that said Letters Patent is hereby corrected as shown below:

Column 10,
Line 11, at end of claim 1 insert the following paragraph:
-- equipment for further conveying the transport containers at said filling location. --.

Signed and Sealed this

Eighteenth Day of April, 2006

JON W. DUDAS
*Director of the United States Patent and Trademark Office*